US012276183B2

(12) United States Patent
Archibald

(10) Patent No.: US 12,276,183 B2
(45) Date of Patent: Apr. 15, 2025

(54) PERFORATING-GUN INITIATOR CIRCUIT

(71) Applicant: Probe Technology Services, Inc., Fort Worth, TX (US)

(72) Inventor: Roger Archibald, Hurst, TX (US)

(73) Assignee: Probe Technology Services, Inc., Fort Worth, TX (US)

( * ) Notice: Subject to any disclaimer, the term of this patent is extended or adjusted under 35 U.S.C. 154(b) by 498 days.

(21) Appl. No.: 17/879,856

(22) Filed: Aug. 3, 2022

(65) Prior Publication Data

US 2024/0044230 A1 Feb. 8, 2024

(51) Int. Cl.
*E21B 43/1185* (2006.01)
*E21B 47/12* (2012.01)
*F42D 1/05* (2006.01)

(52) U.S. Cl.
CPC ..... *E21B 43/1185* (2013.01); *E21B 47/12* (2013.01); *F42D 1/05* (2013.01)

(58) Field of Classification Search
CPC ..... E21B 43/1185; E21B 47/12; F42D 1/05
See application file for complete search history.

(56) References Cited

U.S. PATENT DOCUMENTS 4,208,966 A * 6/1980 Hart ..... F42D 1/055 340/856.4
6,298,924 B1 10/2001 Vaynshteyn et al.
7,347,278 B2 3/2008 Lerche et al.
7,505,244 B2 3/2009 Lerche et al.
7,980,309 B2 7/2011 Crawford
8,091,477 B2 1/2012 Brooks et al.
8,230,788 B2 7/2012 Brooks et al.
8,576,090 B2 11/2013 Lerche et al.
8,689,868 B2 4/2014 Lerche et al.
8,884,778 B2 11/2014 Lerche et al.
9,518,454 B2 12/2016 Current et al.
9,581,422 B2 2/2017 Preiss et al.
9,605,937 B2 3/2017 Eitschberger et al.
9,880,146 B2 * 1/2018 Troxler ..... G01N 33/246
9,890,620 B2 2/2018 Maxted et al.
9,903,695 B1 2/2018 Goodman et al.
10,047,592 B2 8/2018 Burgos et al.
10,309,812 B1 * 6/2019 Zhang ..... G01F 1/86
10,337,270 B2 7/2019 Carisella et al.
10,767,453 B2 9/2020 Phelps et al.
10,809,175 B1 * 10/2020 Ayadat ..... G01N 15/0826
10,830,566 B2 11/2020 Maxted et al.
10,900,334 B2 1/2021 Knight et al.
10,900,335 B2 1/2021 Knight et al.
11,078,765 B2 8/2021 Davis et al.
2014/0151018 A1 * 6/2014 Lerche ..... E21B 43/11857 102/202.5
2016/0216404 A1 * 7/2016 Kristensen ..... E21B 49/10
2017/0212269 A1 * 7/2017 Itskovich ..... G01V 3/26
(Continued)

*Primary Examiner* — Amine Benlagsir

(57) ABSTRACT

An initiator circuit for a perforating gun includes a microprocessor structured to perform a circuit-startup algorithm comprising determining whether the circuit supply voltage is stable enough for operation and, if it is, or if a predetermined period of time has passed since powering up the circuit, sending a message indicating the circuit (and thus gun) is ready for operation. The sent message may be a communication uplink indicating an address of the circuit and its ready state or a short burst of pulses indicating the circuit's ready state.

16 Claims, 5 Drawing Sheets

(56) References Cited

U.S. PATENT DOCUMENTS

| | | | | |
|---|---|---|---|---|
| 2017/0314390 | A1* | 11/2017 | Thompson | H01P 3/082 |
| 2018/0266233 | A1* | 9/2018 | Ahmed | E21B 47/047 |
| 2018/0349508 | A1* | 12/2018 | Bequet | G06F 18/217 |
| 2018/0371894 | A1* | 12/2018 | Wang | E21B 41/00 |
| 2019/0195063 | A1* | 6/2019 | Weston | E21B 47/022 |
| 2019/0390547 | A1* | 12/2019 | Pietrzyk | G05B 15/02 |
| 2021/0048284 | A1 | 2/2021 | Maxted et al. | |
| 2021/0055092 | A1 | 2/2021 | Sullivan et al. | |
| 2021/0207934 | A1 | 7/2021 | Sullivan et al. | |
| 2021/0222525 | A1 | 7/2021 | Dyess et al. | |
| 2021/0223007 | A1 | 7/2021 | Kash et al. | |
| 2021/0230986 | A1 | 7/2021 | MacGillivray | |
| 2021/0340847 | A1 | 11/2021 | Davis et al. | |
| 2022/0034221 | A1 | 2/2022 | Archibald | |

* cited by examiner

PERFORATING-GUN INITIATOR CIRCUIT

BACKGROUND AND SUMMARY

This invention pertains generally to technology for controlling perforating guns for deployment in, e.g., oil and gas wells. More specifically, the technology relates to addressable microprocessor-based gun initiator circuits with a time-sensitive startup routine.

Perforating guns are used in oil and gas well to perforate casing to access oil or gas reserves. Typically, the guns are deployed into the casing in a wellbore using an electrically conductive wireline. The guns include explosive charges which, when fired, proceed from the gun through the casing, thus perforating the casing. To ensure safe operation of the guns, the firing circuit in a gun is typically disabled by default and is selectively enabled through use of an initiator circuit (also known as a switch).

To enable stacking of multiple guns and selective fire of each gun independently of other guns, the initiator circuit is typically configured with an address that is unique in the stack of guns. The initiator circuit communicates with a surface system through the wireline using its address: messages from the initiator circuit include the initiator circuit's address and messages to the initiator circuit include the initiator circuit's address. Using the address, each initiator circuit may be, e.g., queried or configured apart from the other guns in the stack.

Guns in a stack are electrically connected to each other through the initiator circuits. Typically, each initiator circuit includes a passthrough switch, which selectively connects a passthrough conductor to a conductor above it in the stack, and ultimately to a conductor in the wireline. The topmost gun in the stack will be connected to the wireline conductor and through that to the surface system. The surface system will communicate with the top-gun initiator circuit and instruct it to enable the feedthrough switch, connecting the wireline conductor to the second-from-top gun in the stack and enabling communication between the surface system and the initiator circuit of the second-from-top gun in the stack. This proceeds until all guns in the stack are connected to the surface system through the enabled passthrough switches and are registered with the surface system.

The stack "inventory" process, the process of connecting to and registering each gun in the stack, can be quite time intense as each initiator circuit in the stack goes through a handshake process with the surface system. Typically, when first powered up, the initiator circuit waits a predetermined period of time, determines the circuit's state (e.g., the presence of a detonator), and then sends an uplink to the surface system informing the surface system of the initiator circuit's address and state, and that the initiator circuit is ready for operation. The surface system will respond with a command to enable the feedthrough switch, initiating the process for the next gun in the stack. (The initiator circuit will periodically send its uplink until it receives a response from the surface system.) This handshake process, the process of establishing communication between an initiator circuit and surface system and registering the initiator circuit (thus, the gun) at the surface system, may, e.g., take on the order of 350-1000 ms for each gun in the stack. Once the inventory process is complete, the field engineer can selectively fire a gun in the stack (using enable/fire commands addressed to the selected gun). After a gun is fired, the field engineer powers down the stack, repowers it, and the inventory process begins again from the start. This can pose long delays between shots. For example, in a shoot-on-the-fly situation, waiting on the inventory process (perhaps 10 s for a 10-20 gun stack) before the next gun is ready to fire may result in the wireline field engineer having to slow down the winch to ensure that the guns are configured before they arrive at the next perforating interval. Thus, the inventory process may add significant time (and therefore expense) to the perforating operation.

Increasing the inventory speed, then, can improve the perforating operation. Thus, it is an object of the present invention to improve the initiator circuit by speeding the inventory process.

In an aspect of the invention, a perforating-gun initiator circuit includes a microprocessor structured according to a startup algorithm that includes monitoring the time from the circuit powering up, monitoring the voltage supplied to the circuit, determining a level of dispersion in the supplied voltage (e.g., variance or range), determining whether the circuit has been powered up for a predetermined amount of time, and determining whether the supply voltage is stable (via the dispersion measurement). If the circuit has been powered up long enough or the voltage is deemed stable enough, the circuit sends an outgoing message indicating that it is ready for operation. The outgoing message may be an uplink comprising an address of the circuit and a circuit-status indicator or it may be a series of pulses indicating the status. In response to an uplink, the circuit may receive a downlink instructing the circuit to set a feedthrough switch (which may connect power to the next gun in the stack). In response to a pulse-burst message, the circuit may receive a responsive pulse burst indicating the circuit should set the feedthrough switch.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
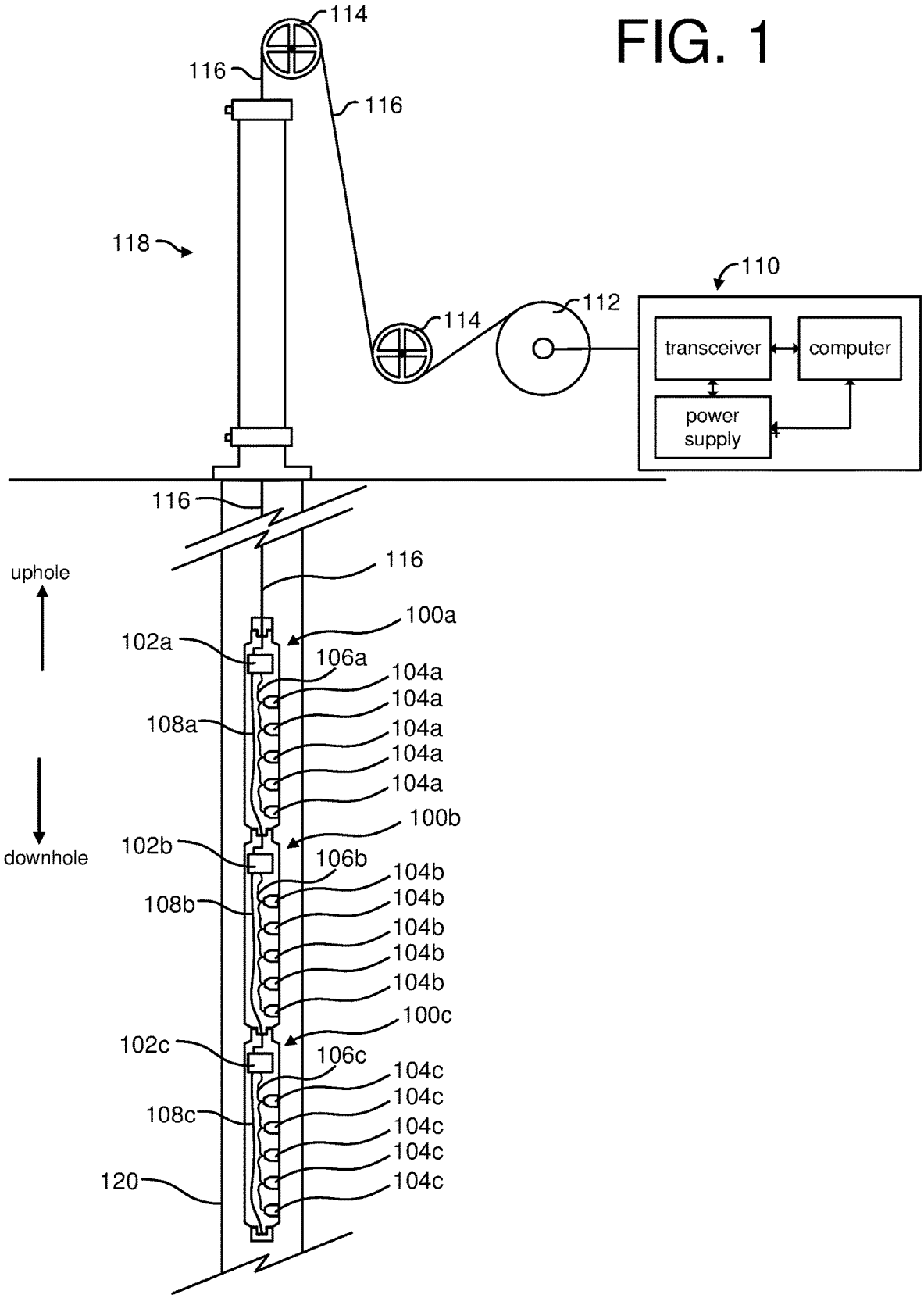
FIG. 1 is a functional block diagram illustrating perforating guns deployed in a cased wellbore via a wireline.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

FIG. 1 illustrates a stack of perforating guns 100*a*, 100*b*, 100*c* deployed in casing 120 in a wellbore as is known in the art. The stack of guns is connected to a surface system 110 via a wireline 116 that runs from a winch 112, through sheaves 114, through pressure control equipment 118, and into the wellbore.

The guns 100*a*, 100*b*, 100*c* in the stack each include one or more explosive charges 104*a*, 104*b*, 104*c* connected to an initiator circuit 102*a*, 102*b*, 102*c* through a detonation cord 106*a*, 106*b*, 106*c* (or other explosive train). As explained in more detail below, each initiator circuit 102*a*, 102*b*, 102*c* includes a microprocessor circuit that is associated with an address (unique in the stack) and that is connected to a detonator. The detonator is in turn connected to the detonator cord 106*a*, 106*b*, 106*c*. The guns 100*a*, 100*b*, 100*c* are connected one-to-the-other through feedthrough lines 108*a*, 108*b*, 108*c*.

In use, the surface system 110 communicates with the initiator circuits 102*a*, 102*b*, 102*c* through use of the addresses of the initiator circuits 102*a*, 102*b*, 102*c*. For example, each gun 100*a*, 100*b*, 100*c* in the stack would be assigned a unique address: e.g., 0xAA, 0xAB, 0xAC; uphole to downhole respectively in the figure. Firing the top gun, 0xAA, would entail sending a signal from the surface system 110 over the wireline 116 wherein the signal includes a firing command associated with the address 0xAA. Similarly, firing the middle gun 102*b* would use the address 0xAB and the bottom gun would use the address 0xAC. Each initiator circuit 102*a*, 102*b*, 102*c* that receives a signal will determine if the command is directed to it through comparison of the address in the command to the initiator circuit's assigned address. If it is the same address, the initiator circuit 102*a*, 102*b*, 102*c* will enable a route for a firing signal to the detonator to trigger the explosive charges 104*a*, 104*b*, 104*c*. In this way, each gun 100*a*, 100*b*, 100*c* in the stack may be selectively fired. Messages other than a firing command may be exchanged between the surface system 110 to the guns 100*a*, 100*b*, 100*c*. For example, the surface system 110 typically performs an inventory of guns 100*a*, 100*b*, 100*c* in the stack. In such a process, the surface determines what guns are in the stack, what the status of each gun is, and registers each gun's address.

Figure 2:
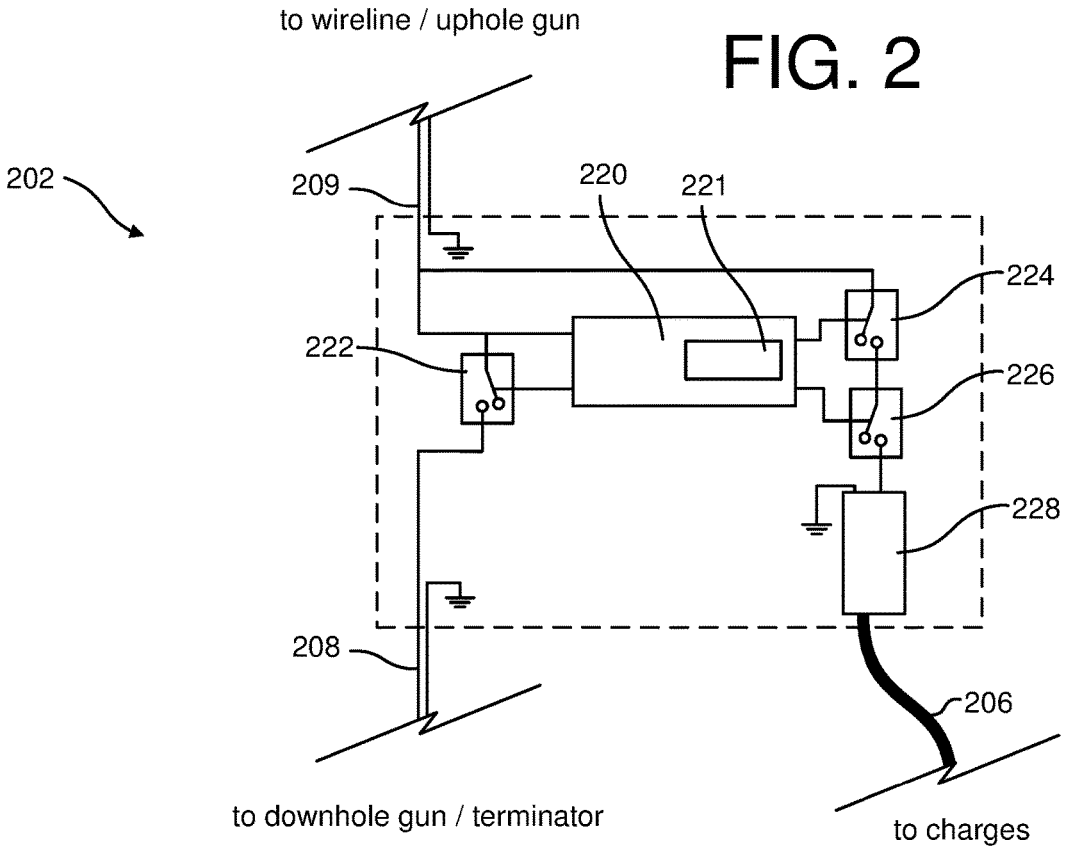
FIG. 2 is a functional block diagram illustrating an exemplary perforating-gun initiator.

FIG. 2 is a functional block diagram illustrating an exemplary initiator circuit 202 comprising a microprocessor circuit 220, a feedthrough switch 222, a high firing switch 224, a low firing switch 226, and a detonator 228 connected to a detonation cord 206. The microprocessor circuit 220 controls the feedthrough 222 and firing 224, 226 switches through a microprocessor 221. For example, the switches may be implemented as field effect transistor switches controlled with signals provided by the microprocessor circuit. The microprocessor circuit 220 also includes communication and support circuitry (not shown) as is known in the art.

On startup, when power is provided to the microprocessor circuit 220 via a supply voltage on a conductor 209 connected to a wireline conductor (perhaps through feedthrough lines and switches of any uphole guns), the microprocessor circuit 220 monitors the voltage and, once the voltage stabilizes to an acceptable level (e.g., variance of less than 8V over the trailing 35 ms) the microprocessor 221 formulates and sends a ready/status message via the wireline-connected conductor 209. The microprocessor 221 continues to periodically send this message until it receives a response from a surface system (or a test box) instructing the microprocessor 221 to enable the feedthrough switch 222. The microprocessor 221 then enables the feedthrough switch 222 thereby providing power to the microprocessor circuit of the next gun in the stack. This process continues until all gun initiators in the gun stack have registered with the surface system (or test box).

Figure 3:
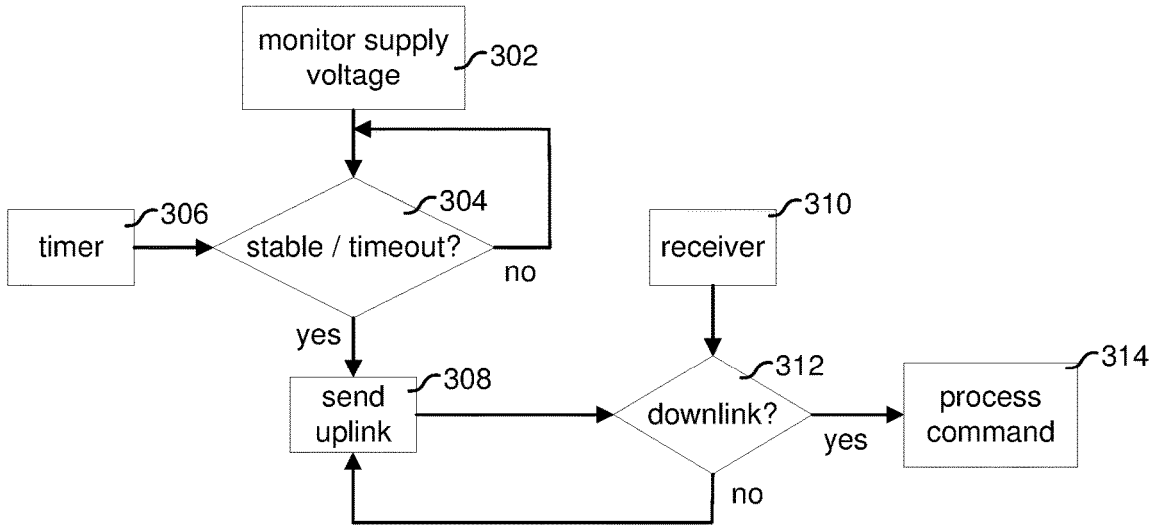
FIG. 3 is a flowchart illustrating an exemplary initiator-circuit startup algorithm according to an aspect of the invention.

An exemplary initiator-circuit startup algorithm is illustrated in FIG. 3. The microprocessor 221 is configured to monitor the supply voltage 302. (It may do this utilizing support circuitry such as an ADC.) The microprocessor 221 is configured to track the supply voltage over time and determine whether the supply voltage is stable enough for operation of the circuit. For example, the microprocessor 221 may track the dispersion in the supply voltage in a trailing period of time, e.g., acquiring a record of the supply voltage amplitude every 1 ms for the trailing 35 ms. This data may be used determine the spread of the amplitude values in the trailing 35 ms. If the spread in the trailing time period is less then (or less than or equal to) a value predetermined to be acceptable for operation, then the power supply is deemed stable and the initiator circuit ready for operation. Any of various measures of dispersion may be used to determine the stability of the supply voltage, such as determining a range, average deviation, or variance in the voltage amplitudes. The measure of dispersion (e.g., range) is compared with a value predetermined to be acceptable for operation. If the dispersion is within a predetermined acceptable range, then the initiator circuit is deemed ready for operation.

The microprocessor 221 is configured to monitor the time from the moment the circuit was powered up 306 and use this time to determine whether to deem the initiator circuit ready for operation. For example, if the time exceeds (or is equal to) some time predetermined to correspond to the circuit being ready for operation (e.g., 250 ms), then sufficient time has run since power up and the initiator circuit is deemed ready for operation.

The microprocessor 221 is configured to determine if the initiator circuit is ready for operation 304 using the supply-voltage dispersion and powered-up time. The circuit may be deemed ready for operation if either condition is met (or both), as described above. For example: if (voltage_range<=3V OR powered_up_time>=250 ms) then READY. If the circuit is not deemed ready for operation, then it continues to check the supply voltage dispersion and powered-up time as described (perhaps performing the check every 1 ms). If the circuit is deemed ready for operation, an uplink is sent 308.

The microprocessor 221 is configured to send an uplink 308 (to the surface system or a test box) once the initiator circuit is deemed ready for operation 304. (It may do this utilizing support circuitry such as a transceiver.) The uplink will include information indicating the address of the initiator circuit (uniquely identifying the gun in the stack) and the READY status of the initiator circuit. Other information may be included in the uplink (e.g., a detonator status). This uplink may be sent periodically until a downlink is received in response (e.g., every 750 ms).

The microprocessor 221 is configured to receive 310 and process information (from the surface system or a test box). If the microprocessor 221 receives a downlink in response to the uplink 312, then the microprocessor proceeds to process the downlink 314. The downlink may include any of a variety of commands to the initiator circuit (e.g., enable feedthrough, change address, arm, fire). If the downlink command is to enable the feedthrough, for example, the microprocessor 221 sets the feedthrough switch 222 to provide a conduction path between the wireline conductor and the next gun in the stack, thereby enabling power up of the initiator circuit of the next gun in the stack.

Figure 4:
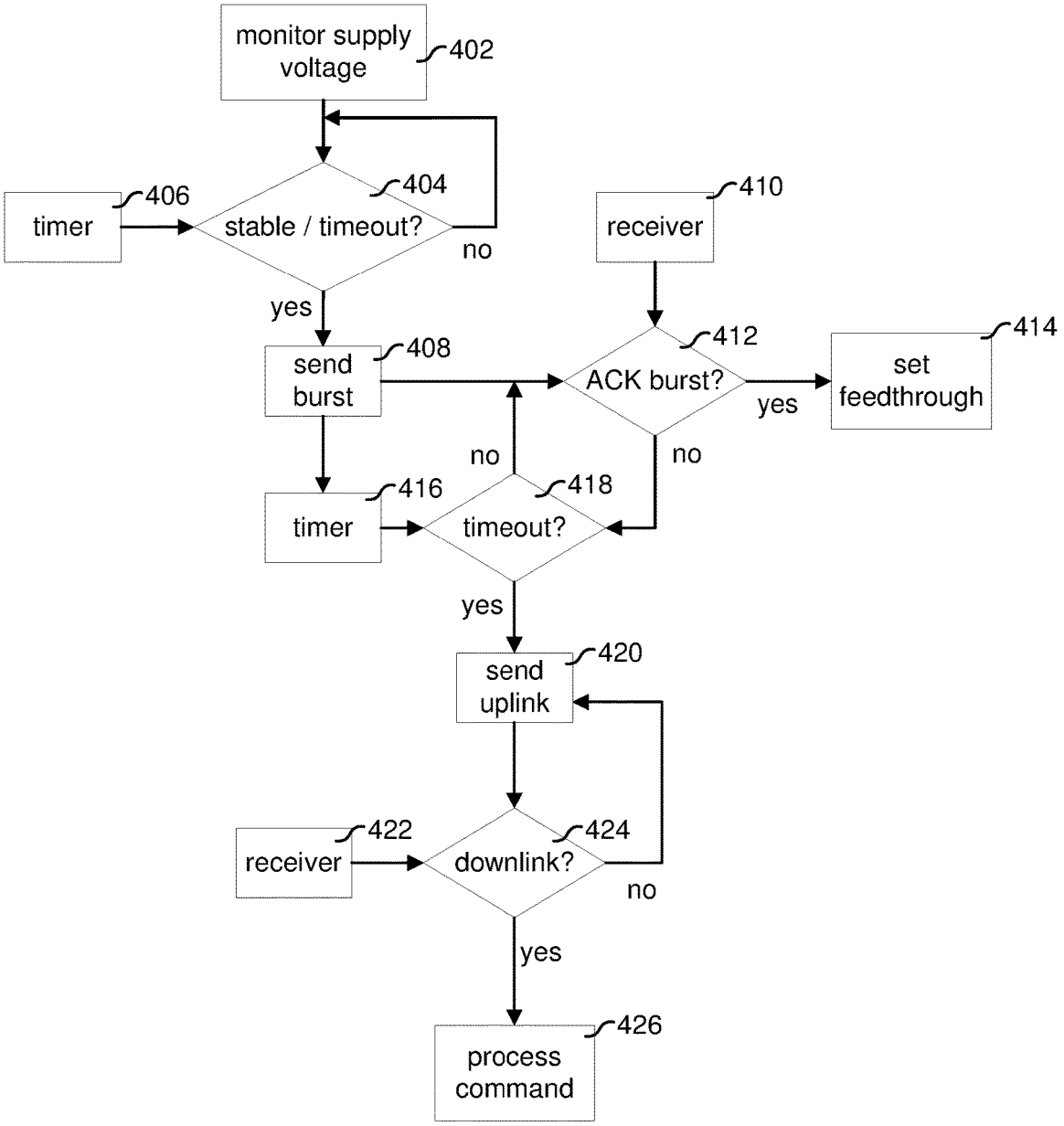
FIG. 4 is a flowchart illustrating another exemplary initiator-circuit startup algorithm according to an aspect of the invention.

Another exemplary initiator-circuit startup algorithm is illustrated in FIG. 4. The microprocessor 221 is configured to monitor the supply voltage 402 as described with reference to FIG. 3 above. The microprocessor 221 may be configured to monitor the time from the moment the circuit was powered up 406 as described with reference to FIG. 3 above. The microprocessor 221 is configured to determine whether the initiator circuit is ready for operation 404, as described with reference to FIG. 3 above. If the initiator circuit is deemed ready for operation, the microprocessor sends a message (to the surface/test box).

The microprocessor 221 is configured to send a burst of pulses 408 when the initiator circuit is ready for operation as a message indicating it is ready. This burst will be uniquely identified as coming from an initiator circuit as distinct from a responsive burst from the surface system. For example, the microprocessor may be configured to send 2 ms of pulses at 3 kHz whereas the surface system may respond with 2 ms of pulses at 2 kHz.

The microprocessor 221 is configured to track the time 415 from sending the burst of pulses 408 and to determine if that time exceeds (or equals to or exceeds) a predetermined threshold deemed a timeout 418. If too much time has passed (e.g., 10 ms) without a response burst, then the process proceeds to send an uplink 420 as described with reference to FIG. 3 above. For example: if (time_since_burst>10 ms) then SEND_UPLINK. The microprocessor then monitors for a downlink 422, 424 and processes the downlink command 426 as described with reference to FIG. 3 above.

The microprocessor 221 is configured to receive 410 and process burst information (from the surface system or a test box). If the microprocessor 221 receives a response burst acknowledging the sent burst 412 then the microprocessor 221 sets the feedthrough switch 222 to provide a conduction path between the wireline conductor and the next gun in the stack, thereby enabling power up of the initiator circuit of the next gun in the stack 414. This received burst will be uniquely identified as a responsive burst from the surface system (as distinct from a initiating burst from an initiator circuit).

Figure 5A:
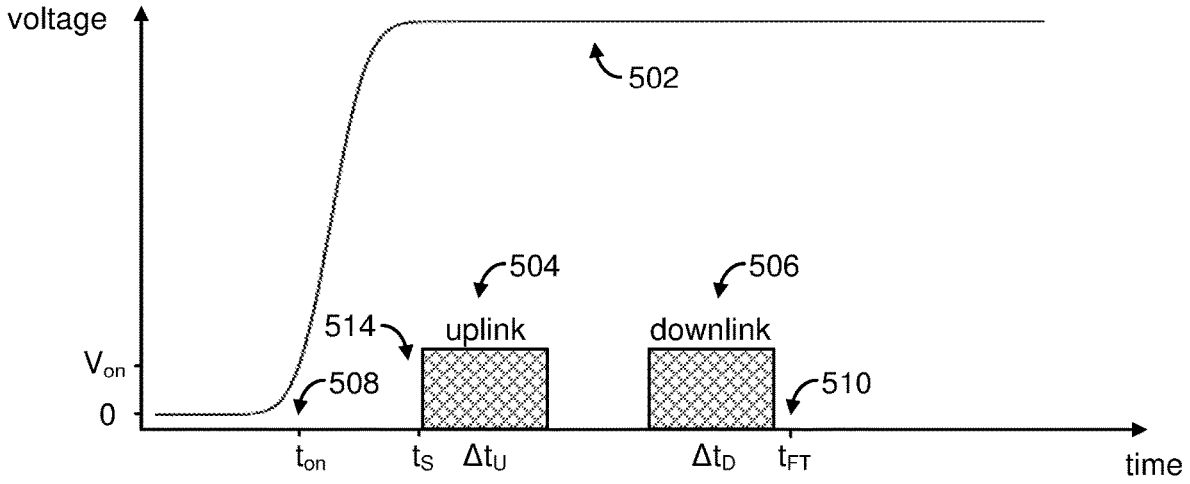
FIGS. 5A-5D are timing diagrams illustrating exemplary timing schemes for exemplary initiator-circuit startup algorithms according to aspects of the invention.
Figure 5B:
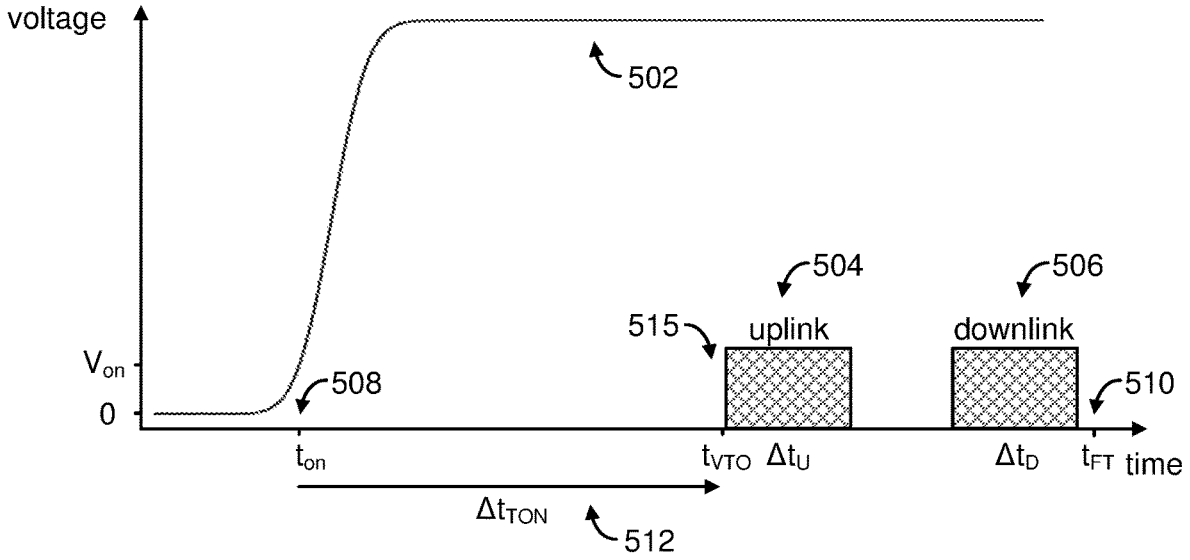

Exemplary timing diagrams for startup routines are illustrated in FIGS. 5A-5D. The timing schemes illustrated in FIGS. 5A and 5B are associated with an exemplary implementation of the startup algorithm illustrated in FIG. 3. The FIG. 5A diagram depicts the voltage provided at the wireline conductor 502, the moment the initiator circuit powers up 508 ($t_{on}$), the moment the voltage is determined to be stable 514 ($t_S$), the timing of an uplink sent from the initiator circuit 504 ($\Delta t_U$), the timing of a downlink received by the initiator circuit 506 ($\Delta t_D$), and the moment the feedthrough switch is set 510 ($t_{FT}$). The FIG. 5B diagram is similar, but depicts a timer showing an amount of time from the circuit powering up 512 ($\Delta t_{TON}$) and a timeout condition. In the FIG. 5A diagram, the voltage is determined to be stable enough for gun operation at $t_S$, before a timeout condition is indicated by the timer $\Delta t_{TON}$. After the voltage is deemed stable at $t_S$, an uplink is sent from the circuit 504, then a responsive downlink is received by the circuit 506, then the feedthrough transistor at $t_{FT}$ 510 is set as indicated by the downlink. In the FIG. 5B diagram, the voltage is never determined stable enough (e.g., because of an ADC failure) and the uplink is sent when the voltage-monitoring timeout condition is satisfied 515 ($t_{VTO}$).

Figure 5C:
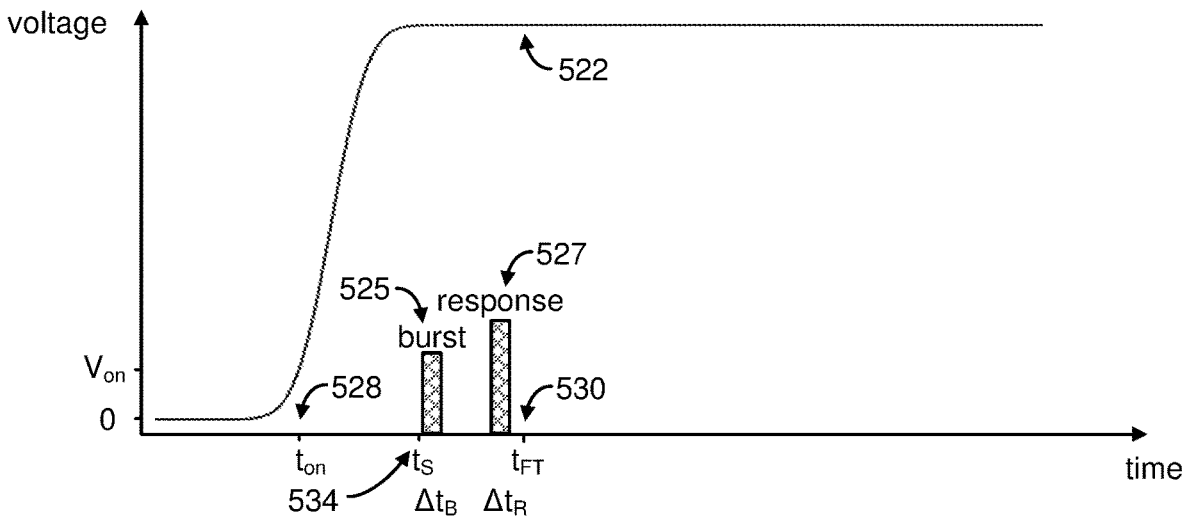
Figure 5D:
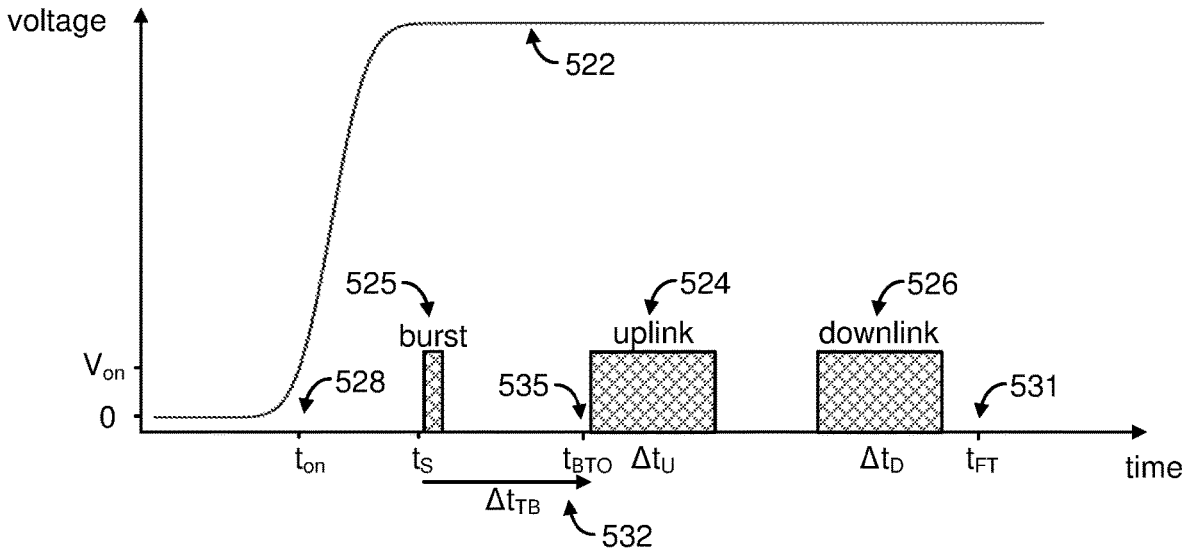

The timing schemes illustrated in FIGS. 5C and 5D are associated with an exemplary implementation of the startup algorithm illustrated in FIG. 4. The FIG. 5C diagram depicts the voltage provided at the wireline conductor 522, the moment the initiator circuit powers up 528 ($t_{on}$), the moment the voltage is determined to be stable 534 ($t_S$), the timing of a pulse burst sent from the initiator circuit 525 ($\Delta t_B$), the timing of a responsive burst received by the initiator circuit 527 ($\Delta t_R$), and the moment the feedthrough switch is set 530 ($t_{FT}$). The FIG. 5D diagram is similar, but depicts a timer showing an amount of time from the start of the burst 532 ($\Delta t_{TB}$) and a timeout condition. In the FIG. 5C diagram, the voltage is determined to be stable enough for gun operation at $t_S$. After the voltage is deemed stable at $t_S$, a pulse burst is sent from the circuit 525, then a responsive pulse burst is received by the circuit 527, then the feedthrough transistor at $t_{FT}$ 530 is set. In the FIG. 5D diagram, a responsive burst is not received in time and an uplink is sent 524 after the burst-monitoring timeout condition is satisfied 535 ($t_{BTO}$), the circuit then receives a downlink 526 and sets the feedthrough switch 531.

As illustrated in FIGS. 5A-5D, the time it takes to set the feedthrough transistor (and register the circuit at the surface) is shorter when based on a successfully measured voltage-stability condition than when based on a strict timing condition ($t_{VTO}$). And the time it takes to set the feedthrough transistor is shorter when based on burst-response messaging than when based on uplink/downlink messaging. In this way, the algorithms speed up the startup/inventory sequence and thus increase the efficiency of the perforating operation.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. An initiator circuit for a perforating gun, the initiator circuit comprising:

(a) a feedthrough switch; and (b) a microprocessor configured to perform a following algorithm:

(i) monitor a powered-up time indicating a time passed since the initiator circuit was powered up;

(ii) monitor a supply-voltage supplied to the initiator circuit;

(iii) determine a dispersion in the supply-voltage by determining the dispersion in the supply-voltage over a first predetermined period of time;

(iv) determine whether the dispersion in the supply-voltage satisfies a predetermined stability condition;

(v) determine whether the powered-up time satisfies a predetermined powered-up-time condition; and (vi) send an outgoing message if either the dispersion in the supply-voltage satisfies the predetermined stability condition or the powered-up time satisfies the predetermined powered-up-time condition.

2. The initiator circuit of claim 1 wherein the outgoing message is an uplink message comprising an address of the initiator circuit and data indicating the initiator circuit is ready for communication.

3. The initiator circuit of claim 1 wherein the outgoing message is a series of pulses.

4. The initiator circuit of claim 3 wherein the series of the pulses has a frequency identifying the series of the pulses as originating from the initiator circuit.

5. The initiator circuit of claim 1, wherein the algorithm performed by the microprocessor is configured to include:

(a) receive an incoming message; and (b) determine if the incoming message is in response to the outgoing message;

(c) set the feedthrough switch if the incoming message is in response to the outgoing message and the incoming message indicates the feedthrough switch is to be set.

6. The initiator circuit of claim 5 wherein the incoming message is a downlink message comprising an address of the initiator circuit and data indicating the initiator circuit should set the feedthrough switch.

7. The initiator circuit of claim 6 wherein the incoming message is a series of pulses identifying the initiator circuit and indicating that the initiator circuit should set the feedthrough switch.

8. The initiator circuit of claim 1 wherein:

(a) the dispersion in the supply-voltage over the first predetermined period of time is one of a group consisting of range of supply voltages, a deviation of the supply-voltage, and a variance of the supply-voltage; and (b) the predetermined stability condition is one of a group consisting of an acceptable range, a maximum deviation value, and a maximum variance value.

9. A method for operating an initiator circuit of a perforating gun, the method comprising:

(a) monitoring, at the initiator circuit comprising a feedthrough switch, a powered-up time indicating a time passed since the initiator circuit was powered up;

(b) Monitoring, at the initiator circuit, a supply-voltage supplied to the initiator circuit;

(c) determining, at the initiator circuit, a dispersion in the supply-voltage by determining the dispersion in the supply-voltage over a first predetermined period of time;

(d) determining, at the initiator circuit, whether the dispersion in the supply-voltage satisfies a predetermined stability condition;

(e) determining, at the initiator circuit, whether the powered-up time satisfies a predetermined powered-up-time condition; and (f) sending, from the initiator circuit, an outgoing message if either the dispersion of the supply-voltage satisfies the predetermined stability condition or the powered-up time satisfies the predetermined powered-up-time condition.

10. The method claim 9 wherein the outgoing message is an uplink message comprising an address of the initiator circuit and data indicating the initiator circuit is ready for communication.

11. The method of claim 9 wherein the outgoing message is a series of pulses.

12. The method of claim 11 wherein the series of the pulses has a frequency identifying the series of the pulses as originating from the initiator circuit.

13. The method claim 9 further comprising:

(a) receiving, at the initiator circuit, an incoming message;

(b) determining, at the initiator circuit, whether the incoming message is in response to the outgoing message; and (c) setting, at the initiator circuit, the feedthrough switch if the incoming message is in response to the outgoing message and the incoming message indicates the feedthrough switch is to be set.

14. The method of claim 13 wherein the incoming message is a downlink message comprising an address of the initiator circuit and data indicating the initiator circuit should set the feedthrough switch.

15. The method of claim 13 wherein the incoming message is a series of pulses identifying the initiator circuit and indicating that the initiator circuit should set the feedthrough switch.

16. The method of claim 9 wherein:

(a) the dispersion in the supply-voltage over the first predetermined period of time is one of a group consisting of range of supply voltages, a deviation of the supply-voltage, and a variance of the supply-voltage; and (b) the predetermined stability condition is one of a group consisting of an acceptable range, a maximum deviation value, and a maximum variance value.

* * * * *